US007377366B2

(12) United States Patent
Det et al.

(10) Patent No.: US 7,377,366 B2
(45) Date of Patent: May 27, 2008

(54) SHEAVE ASSEMBLY FOR AN ELEVATOR SYSTEM

(75) Inventors: Franck Det, St. Martin/Ocre (FR); Davy Depee, Gien (FR); Jean-Noël Cloux, Nogent sur Vernisson (FR); Michel Beeuwsaert, Nevoy (FR); Raphaël Picard, Gien (FR); Pascal Rebillard, Gien (FR); Fernando Rico, Rueil Malmaison (FR); David Pillin, Guipavas (FR); Hugues Fanielle, Orleans (FR); Jacobus Benjamin Legez, DE Kwakel (NL)

(73) Assignee: Otis Elevator Company, Farmington, CT (US)

( * ) Notice: Subject to any disclaimer, the term of this patent is extended or adjusted under 35 U.S.C. 154(b) by 103 days.

(21) Appl. No.: 10/535,922

(22) PCT Filed: Nov. 25, 2002

(86) PCT No.: PCT/US02/37776

§ 371 (c)(1),
(2), (4) Date: May 23, 2005

(87) PCT Pub. No.: WO2004/048246

PCT Pub. Date: Jun. 10, 2004

(65) Prior Publication Data

US 2006/0175149 A1 Aug. 10, 2006

(51) Int. Cl.
*B66B 7/02* (2006.01)

(52) U.S. Cl. ..... 187/406; 187/254; 187/250; 187/256; 187/266

(58) Field of Classification Search ..... 187/254, 187/250, 256; 254/266
See application file for complete search history.

(56) References Cited

U.S. PATENT DOCUMENTS

| | | | | |
|---|---|---|---|---|
| 3,279,762 | A * | 10/1966 | Bruns | 254/266 |
| 5,009,288 | A * | 4/1991 | Nakai et al. | 187/411 |
| 5,533,595 | A * | 7/1996 | Narumi et al. | 187/266 |
| 6,405,833 | B1 * | 6/2002 | Baranda et al. | 187/254 |
| 6,598,707 | B2 * | 7/2003 | Nakagaki et al. | 187/256 |
| 6,640,935 | B1 * | 11/2003 | Murakami et al. | 187/401 |
| 2001/0040071 | A1 * | 11/2001 | Sasaki | 187/373 |
| 2002/0000348 | A1 | 1/2002 | Faletto | |
| 2002/0070080 | A1 | 6/2002 | Nakagaki et al. | |
| 2006/0070822 | A1 * | 4/2006 | Osada et al. | 187/350 |

FOREIGN PATENT DOCUMENTS

| | | |
|---|---|---|
| DE | 1 032 496 | 6/1958 |
| EP | 1 400 479 | 3/2004 |

(Continued)

OTHER PUBLICATIONS

Supplementary European Search Report dated Nov. 10, 2005.
International Search Report dated Mar. 20, 2003.

*Primary Examiner*—Patrick Mackey
*Assistant Examiner*—Terrell Matthews

(57) ABSTRACT

An elevator system includes guide rail mounted machine (16) and a sheave assembly (32) that accommodates a guide rail (38) within a hoistway. The inventive sheave assembly includes individual sheave portions (54) rotatable along a common axis. At least two of the sheave portions are spaced apart along a shaft (50) and a portion of the guide rail extends toward the axis beyond a plane formed tangent to the outside diameter of the sheave portions.

10 Claims, 5 Drawing Sheets

FOREIGN PATENT DOCUMENTS

| | | |
|---|---|---|
| FR | 2 823 734 | 10/2002 |
| JP | 05278974 | 10/1993 |
| JP | 2000-072359 | 3/2000 |
| JP | 2001-039647 | 2/2001 |
| JP | 2002-068636 | 3/2002 |
| JP | 2002-179356 | 6/2002 |
| JP | 05-278974 | 10/2003 |
| WO | WO 00/37349 | 6/2000 |

* cited by examiner

SHEAVE ASSEMBLY FOR AN ELEVATOR SYSTEM

BACKGROUND OF THE INVENTION

This invention generally relates to elevator systems and more specifically to a space efficient elevator system including a guide rail mounted machine and a sheave design that accommodates the guide rail.

Elevator systems typically include a car and counterweight that move within a hoistway. Roping couples the car and counterweight and supports them as they move. A motor drives the rope to raise and lower the car. Typically, the car includes a roller assembly that cooperates with a guide rail to guide the car within the hoistway. Traditionally, the motor has been mounted within a machine room disposed at the top of the hoistway.

Idler sheaves disposed on the elevator car, for example, form part of a system of roping for raising and lowering the car along with the counterweight. Roping is threaded through idler sheaves at various location in the system, for example, the elevator car and counterweight. The idler sheaves necessarily take up space within the hoistway and the guide rail extends from the interior surface of the hoistway walls toward the elevator car. Various machine mounting strategies have been proposed but building and safety codes require sometimes expensive devices and controls.

Recently, machine room-less elevator systems have been developed that no longer require a separate machine room. Machine room-less elevator systems were developed in response to consumer demands for simpler, more efficient use of space dedicated to elevator systems. Even with such systems, there still is need to decrease the space occupied by an elevator system.

It is desirable to minimize system expenses to conserve hoistway space and allow for easy installation of the elevator car within the hoistway. Further, buildings typically are not designed to make special accommodations for elevator systems.

For these reasons it is desirable to design an elevator system adaptable to efficiently utilize hoistway space. This invention addresses these needs.

SUMMARY OF THE INVENTION

In general terms this invention is an elevator system having a unique sheave arrangement that accommodates a portion of a guide rail, requires less space within a hoistway and allows more versatility in arranging the components in the system.

An elevator system designed according to this invention includes a car and at least one guide rail to guide the car as it moves within a hoistway. A sheave assembly mounted to the car includes at least two sheave portions rotatable about a common axis with a spacing between the portions. The sheave portions are mounted either about a common shaft or about separate shafts disposed about the common axis. The rail extends into the spacing between sheave portions such that at least a portion of the rail is accommodated within the spacing between the sheave portions.

Accordingly, the inventive arrangement of system components provides a more efficient, space saving elevator system.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENTS

Figure 1:
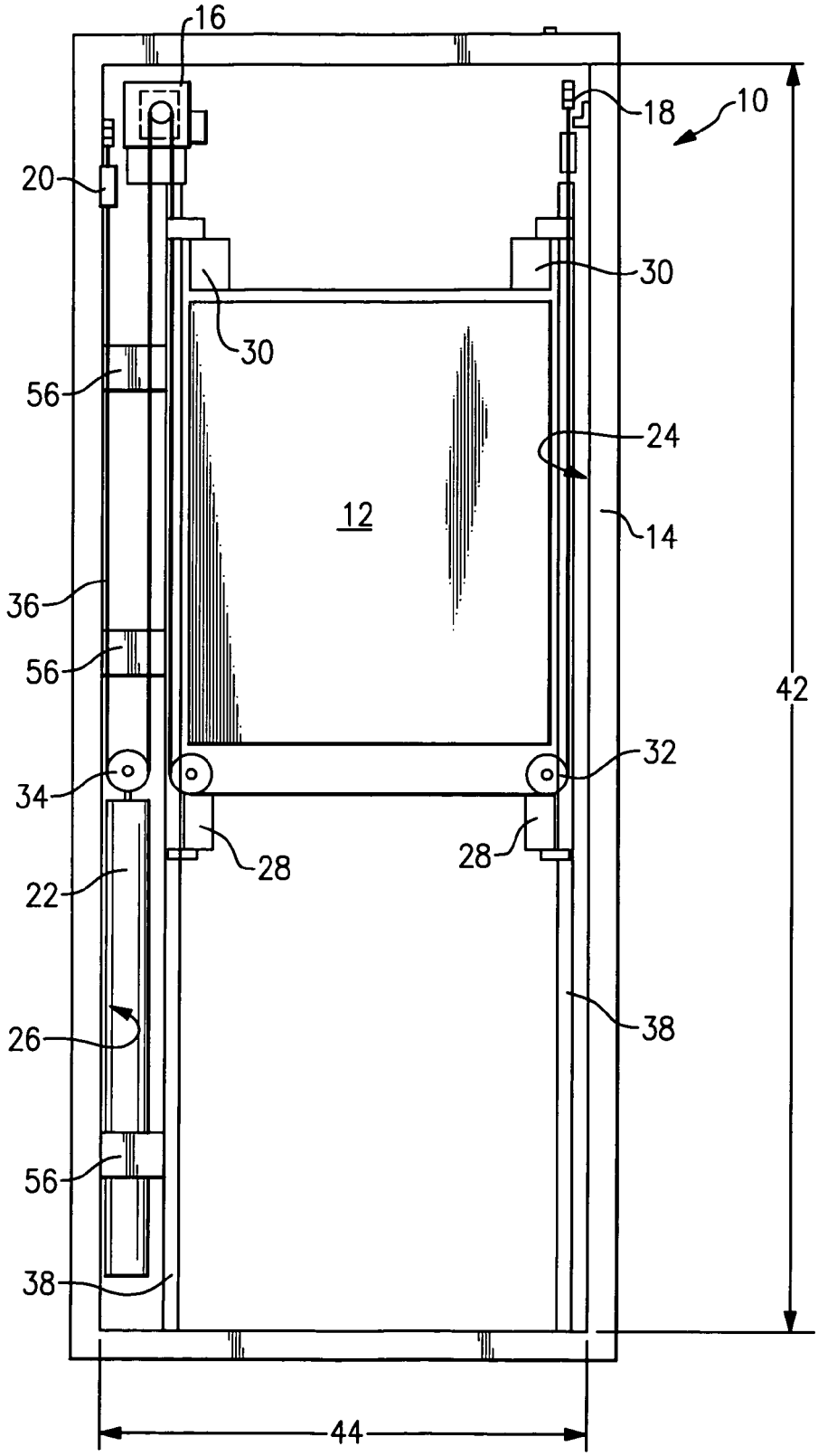
FIG. 1 schematically shows an elevator system designed according to this invention.
Figure 2:
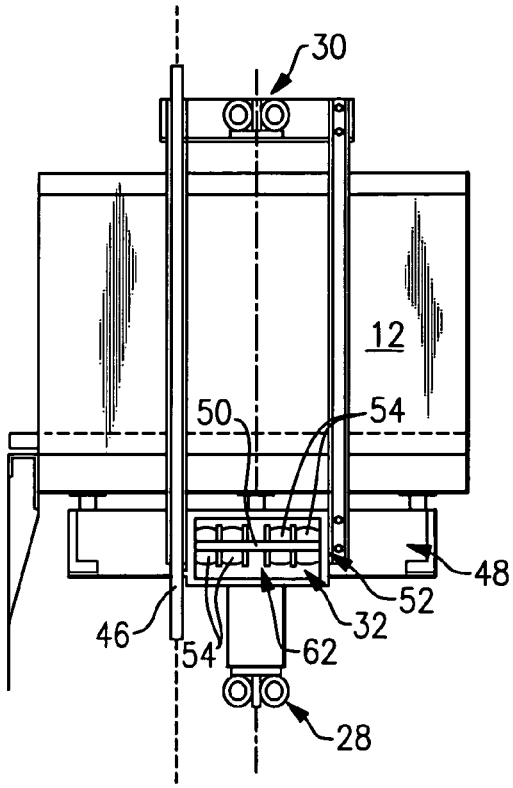
FIG. 2 is a side view of an elevator car including guide rollers and idler sheave assemblies.

Referring to FIGS. 1 and 2, an embodiment of this invention is an elevator system 10 including an elevator car 12 supported for movement within a hoistway 14. The hoistway 14 includes guide rails 38 positioned on an interior wall 24 of the hoistway 14 and mounted to counter-weight brackets 56. The counter-weight brackets 56 are mounted to an opposite interior wall 26. The guide rails 38 guide movement of the elevator car 12 within the hoistway 14. The counter-weight bracket 56 provides a space extending the entire height 42 of the hoistway 14 for movement of a counter-weight 22.

The counterweight 22 moves when the elevator car 12 moves as known. The counterweight 22 is guided by guide rails 40 mounted within the hoistway (shown in FIG. 3). The elevator car 12 and counterweight 22 include sheave assemblies 32, 34 that cooperate with roping 36 and a machine 16 to raise and lower the elevator car 12. In the illustrated example the sheave assemblies 32 are mounted to a base 48 of the elevator car 12, however, it is within the contemplation of this invention that the sheave assemblies 32 may be mounted on other locations on the elevator car 12 or elsewhere in the system 10 as may be needed as are known to a worker skilled in the art. The elevator car 12 also includes roller assemblies 28, 30 disposed on a top and bottom of the elevator car 12 that ride along the guide rails 38 maintaining proper alignment of the elevator car 12.

The machine 16 of the example elevator system 10 is positioned and supported atop at least one of the guide rails 38, 40. Supporting the machine 16 atop the guide rails 38,40 eliminates the need for a separate machine room required in conventional elevator systems. The machine room-less elevator system 10 is designed to efficiently use hoistway space 14 and eliminate the requirement of a separate machine room. Using a guide rail to support the machine 16 provides the further advantage of minimizing the number of components.

The elevator system 10 optimizes space use within the hoistway 14. The inventive approach allows the guide rails 38 to be positioned as close to the elevator car 12 as is possible. The sheave assemblies 32 include a spacing 62 between profiled belt engaging portions 54, allowing the guide rails 38 to extend closer to the elevator car 12.

The sheave assemblies 32 are disposed on the base 48 of the elevator car 12 and at least two belts 36 thread about the idler sheave assemblies disposed on either side of the elevator car 12 and are fixed at one end to a dead end hitch 18 mounted atop one of the guide rails 38. The other end of each belt 36 is fixed to dead end hitch 20 mounted atop the guide rail 38 with the machine 16 after threading through the idler sheave assembly 34 of the counterweight 22 and over the machine 16. The illustrated configuration of roping is only one type and it should be understood that other configurations of hoistway roping for raising and lowering the elevator car 12 are within the contemplation of this invention.

Figure 3:
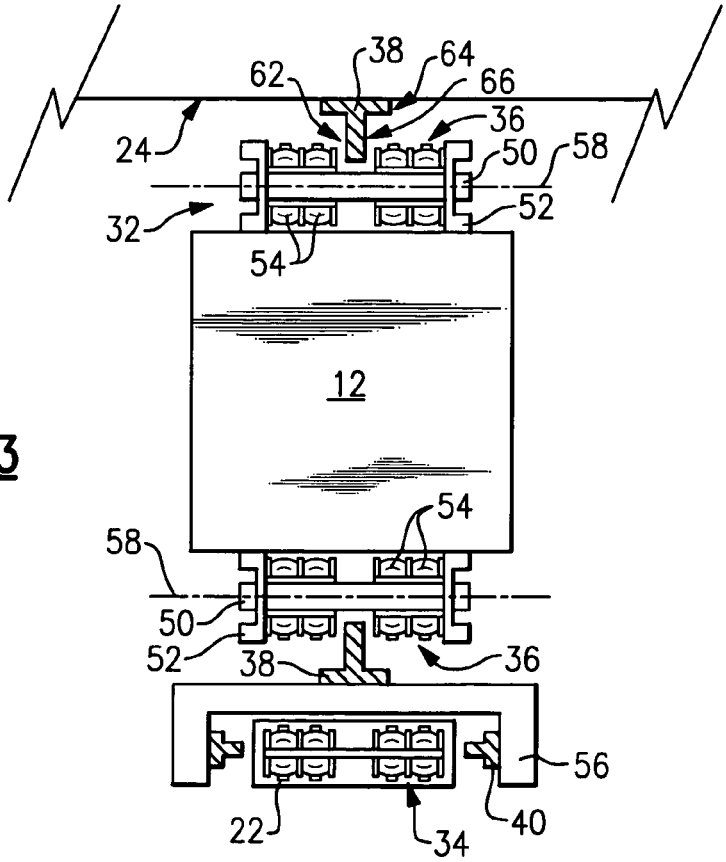
FIG. 3 is a top view of the elevator car and counterweight.

Referring to FIG. 3, each of the guide rails 38 includes a mount portion 64 mounted to the interior wall 24 or to the counter-weight bracket 56. Extending from the rail mount 64 is a guide portion 66. The guide portion 66 cooperates with the roller assemblies 28,30 as known. Space within the hoistway 14 is conserved by allowing the guide portion 66 of the guide rails 38 to extend toward the car 12 beyond the belt engaging surfaces on the sheave portions 54 of the sheave assemblies 32. Extending the guide portion 66 of each guide rail 38 between sheaves 54 of the sheave assembly 32 reduces the amount of space utilized for components of the elevator system 10 to conserve space within the hoistway 14.

Figure 4:
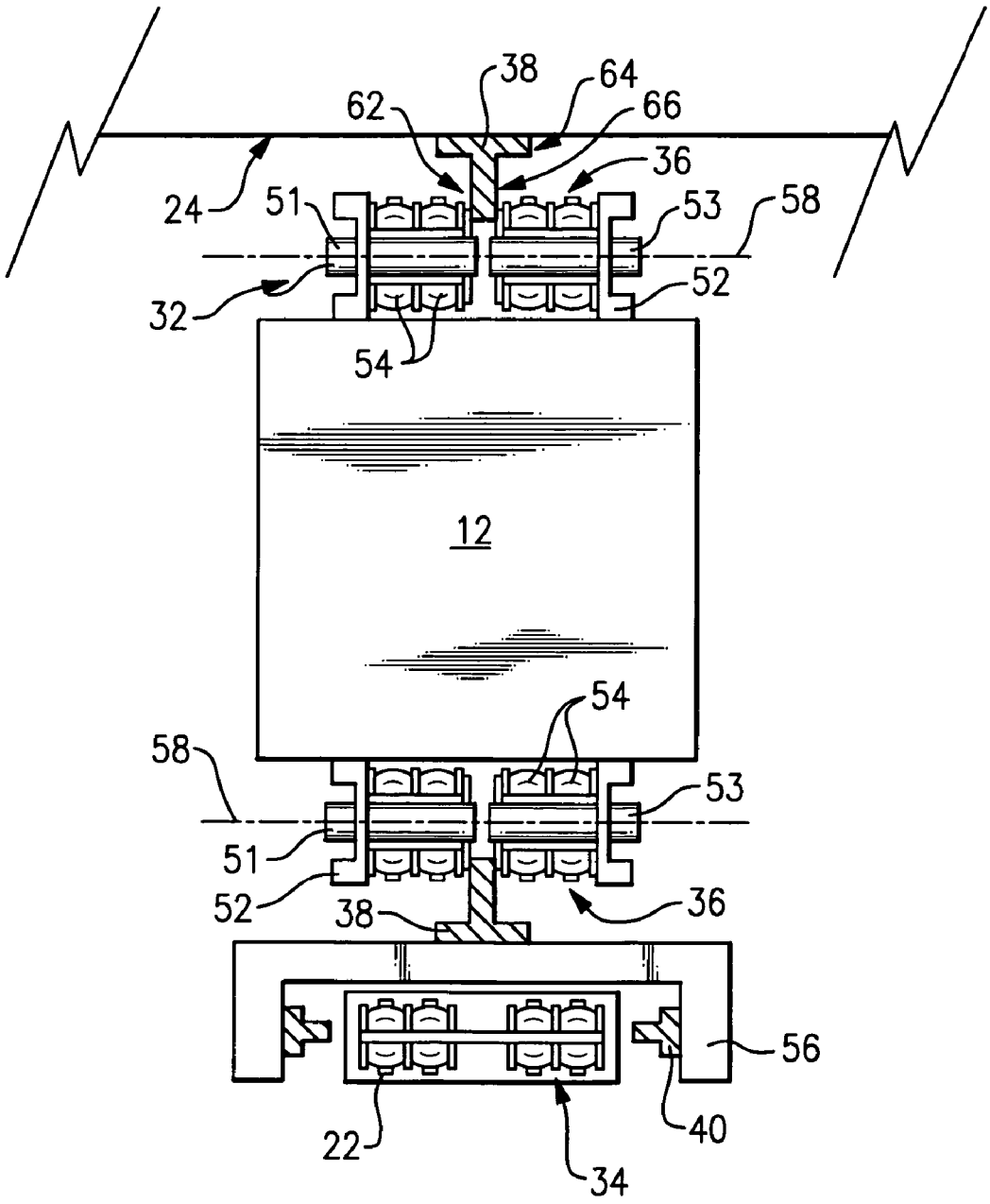
FIG. 4 is a top view of another embodiment of this invention.

The example sheave assembly 32 includes four individual sheave portions 54 supported about a common shaft 50. A spacing 62 separates the sheave portions 54 into two separate groups of two idler sheave portions 54. Each of the idler sheave portions 54 includes an outer diameter 74 (FIG. 4). Some of the guide portion 66 of each guide rail 38 extends into the spacing 62 between a plane 72, tangent to the outer diameter 74 of the sheave portions 54, and the shaft 50. The spacing 62 has a smaller outside dimension than the outside diameter 74 of the sheave portions. In the illustrated example, the outer dimension of the shaft 50 establishes this smaller outside dimension.

Referring to FIG. 4, in another embodiment of this invention separate shafts 51 and 53 are supported about the common axis 58 to rotatably support sheave portions 54. In this embodiment, the smaller outside dimension is further decreased relative to the embodiment shown in FIG. 3 with common shaft 50.

Figure 5:
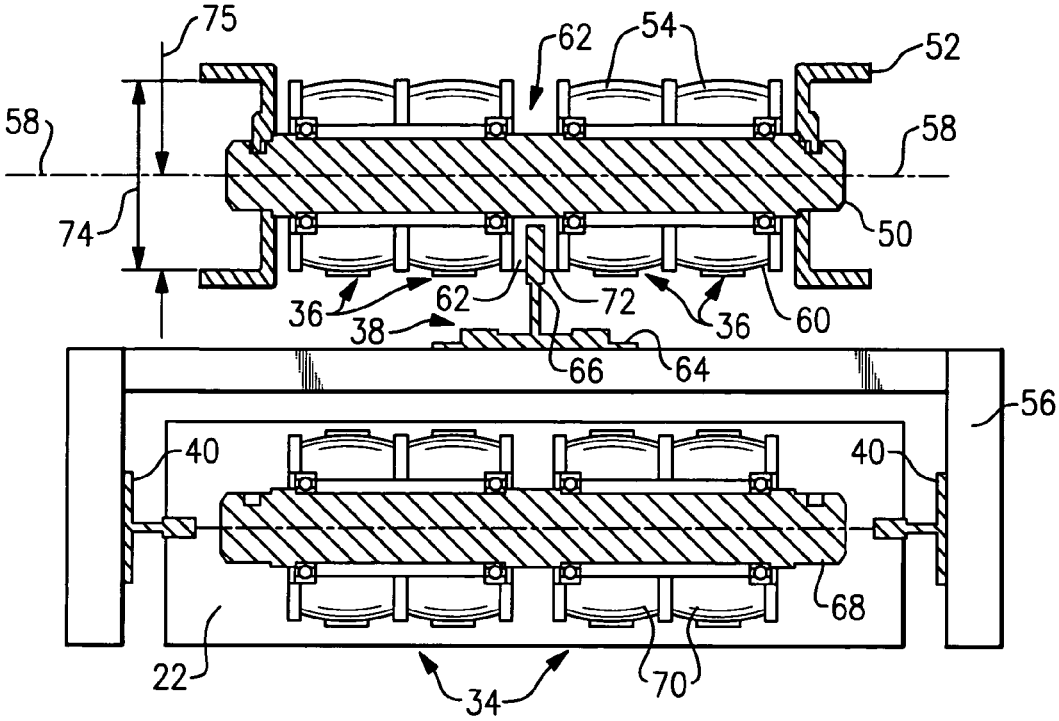
FIG. 5 is an enlarged view of the idler sheave assembly of the elevator car and counterweight.

Referring to FIG. 5, the shaft 50 is supported by the support member 52 attached to the elevator car 12. Each of the sheaves 54 includes the outer diameter 74. The outer diameter 74 is spaced a first distance 75 from the axis of rotation 58. The guide portion 66 of the guide rail 38 is spaced from the axis of rotation a second distance 77. The second distance 77 is less then the first distance 75 such that a portion of the guide rail is within the spacing 62 between sheave portions. In other words, the plane 72 tangent to the outer diameter 74 of the sheave portions 54 extends across the spacing 62 and at least a portion of the guide 66 of the guide rail 38 intersects the plane 72.

Figure 6:
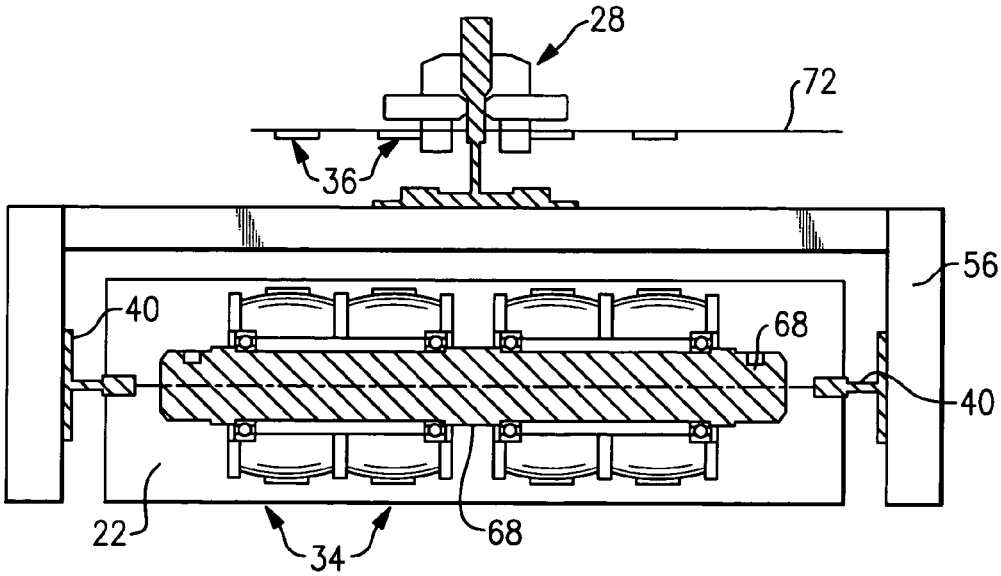
FIG. 6 is an enlarged view of the roller assembly of the elevator car and the sheave assemblies on the counterweight.

Referring to FIG. 6, the guide rail 38 engages the roller assembly 28 of elevator car 12. The ropes 36 are shown in relative position to the guide rail 38 and roller assembly 28. The plane 72 tangent with the outer diameter 74 of the sheaves 54 is shown relative to the ropes 36 and intersects a portion of the guide rail 38. Mounting the idler sheave assemblies 32 to create the spacing 62 through which the guide portion 66 can extend provides increased space for use by the elevator car 12 and efficiently allocates precious and valuable space within the hoistway 14. The increased space within the hoistway 14 provided by this invention accommodates consumer demands for efficient use of hoistway space.

Referring to FIG. 5, an enlarged view is shown of the sheave assembly 32. The sheave portions 54 are supported about the axis 58 by the common shaft 50 and includes bearing assemblies 60 mounted within each sheave portion 54. The bearing assemblies 60 may be of any type known to a worker skilled in the art. In this embodiment, two sheave portions 54 are shown on either side of the guide rail 38 along with corresponding roping 36. It should be understood that it within the contemplation of this invention that separate shafts be used for supporting the sheave portions 54.

Figure 7:
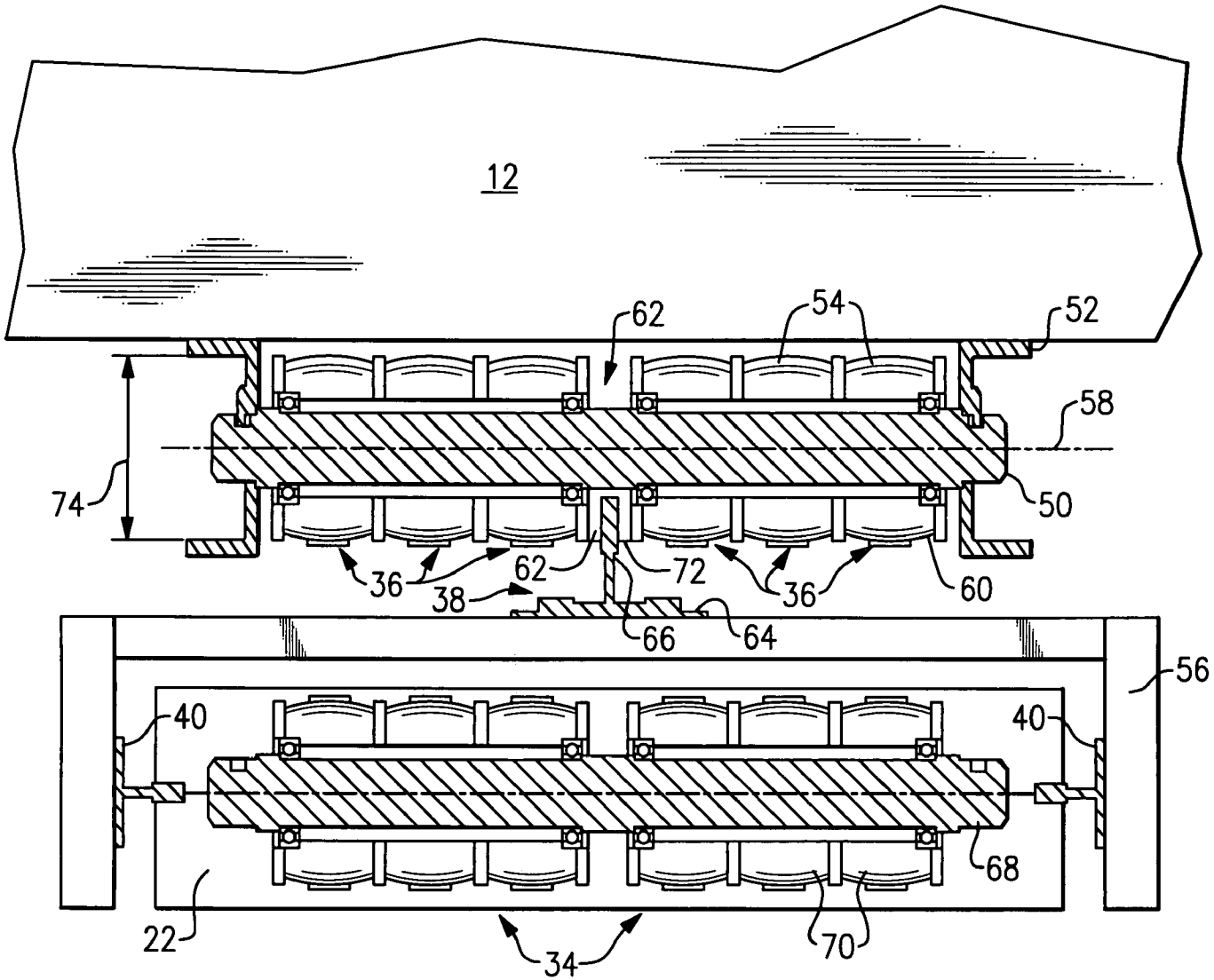
FIG. 7 is an enlarged view of another embodiment of the idler sheave assembly.

Referring to FIG. 7, another embodiment of the sheave assembly is shown including three idler sheave portions 54 on each side of the spacing 62. The number of sheave portions 54 disposed on either side of the guide rail 38 is application specific and may include two, three, four, or any combinations thereof as required by specific application requirements.

The counterweight 22 includes sheave assemblies 34 similar to the sheave assemblies 32 mounted on the elevator car 12. The guide rails 40 for the counterweight 22 do not extend between the sheave portions 54 of the sheave assembly 34 mounted on the counter-weight 22 in this example.

The foregoing description is exemplary and not just a material specification. The invention has been described in an illustrative manner, and it should be understood that the terminology used is intended to be in the nature of words of description rather than of limitation. Modifications and variations are possible in light of the above teachings. The preferred embodiments of this invention have been disclosed, however, one of ordinary skill in the art would recognize that certain modifications are within the scope of this invention. It is to be understood that within the scope of the appended claims, the invention may be practiced otherwise than as specifically described. For that reason the following claims should be studied to determine the true scope and content of this invention.

We claim:

1. An elevator system comprising:

at least one rail;

a car that is selectively movable along said rail; and a sheave assembly supported on said car having at least two sheave portions rotatable about common axis, where said sheave assembly includes a spacing between said at least two sheave portions with said rail extending into the spacing, and a common shaft supports said sheave portions.

2. The system of claim 1, including a plurality of separate sheave portions disposed on either side of said rail.

3. The system of claim 1, including a machine mounted on said rail.

4. The system of claim 1, including a counterweight having a sheave assembly having at least two sheave portions rotatable about a common axis with a spacing between the portions.

5. The system of claim 4, including a common shaft supporting said two sheave portions of said counterweight.

6. The system of claim 4, including separate shafts supporting said sheave portions of said counterweight.

7. An elevator system comprising:

at least one rail;

a car that is selectively movable along said rail;

a sheave assembly supported on said car having at least two sheave portions rotatable about a common axis with a spacing between said at least two sheave portions with said rail extending into said spacing;

a counterweight having a sheave assembly having at least two sheave portions rotatable about a common axis with a spacing between the portions; and a combined bracket supporting at least one of said rails for said car and rails for said counterweight.

8. The system of claim 1, wherein said sheave assemblies are mounted to a bottom portion of said car.

9. The system of claim 1, wherein said sheave assemblies are mounted to a top portion of said car.

10. The system of claim 1, including a guide assembly mounted to said car and engaged to said rail for guiding said car.

* * * * *